US005461282A

United States Patent [19]

Scheitrum et al.

[11] Patent Number: 5,461,282

[45] Date of Patent: Oct. 24, 1995

[54] ADVANCED CENTER POST ELECTRON GUN

[75] Inventors: Glenn P. Scheitrum, San Mateo; Richard B. True, Santa Clara, both of Calif.

[73] Assignee: Litton Systems, Inc., Beverly Hills, Calif.

[21] Appl. No.: 14,376

[22] Filed: Feb. 5, 1993

[51] Int. Cl.[6] ..... H01J 23/07

[52] U.S. Cl. ..... 315/5.31; 315/5.33; 315/5.35; 313/453; 313/455; 313/448; 313/157

[58] Field of Search ..... 315/5.31, 5.33, 315/5.34, 5.35; 313/453–455, 448, 446, 326, 157

[56] References Cited

U.S. PATENT DOCUMENTS

| | | | |
|---|---|---|---|
| 2,812,467 | 11/1957 | Kompfner | 315/5.31 X |
| 3,013,179 | 12/1961 | Harris | 315/5.34 X |
| 4,583,021 | 4/1986 | Herriott et al. | 313/304 |
| 4,737,680 | 4/1988 | True et al. | 313/349 |
| 4,897,609 | 1/1990 | Mallavarpu | 330/43 |
| 4,912,366 | 3/1990 | Dionne | 315/5.31 X |
| 4,988,956 | 1/1991 | Ono et al. | 331/82 X |

OTHER PUBLICATIONS

Vanderplaats, N. R., et al; "Magnetically Shielded Electron Guns with a Center Magnetic Post"; *Int'l Electron Devices Meeting Proceedings;* Washington D.C. U.S.A; (7–9 Dec. 1981: pp. 336–338.

Scheitrum, G. P. et al; "A Triple Pole Piece Magnetic Field Reversal Element for Generation of High Rotational Energy Beams"; *Int'l Electron Devices Meeting Proceedings;* Wash. D.C. USA (7–9 Dec 1981); pp. 332–335.

*Primary Examiner*—Benny T. Lee
*Attorney, Agent, or Firm*—Graham & James

[57] ABSTRACT

An advanced center post (ACP) gun is provided which is capable of producing either a large orbit or small orbit electron beam. The gun comprises an annular shaped cathode, a control electrode adjacent the cathode, and an annular anode having an opening therethrough. A center post is disposed axially within the center region of the cathode and the control electrode along a center line of the electron gun and interaction region of a microwave device. The anode is shaped in conjunction with the center post to control position of equipotential lines of an electric field provided in an inter-electrode space between the cathode and the anode so that an electron beam emitted by the cathode converges at the anode opening. The control electrode provides electrostatic focusing of the beam to further control the beam convergence. Multiple polepieces provide accurate control of the magnetic field in the interaction region to shape the beam and control the orbit size and velocity spread.

25 Claims, 6 Drawing Sheets

FIG. 1 PRIOR ART
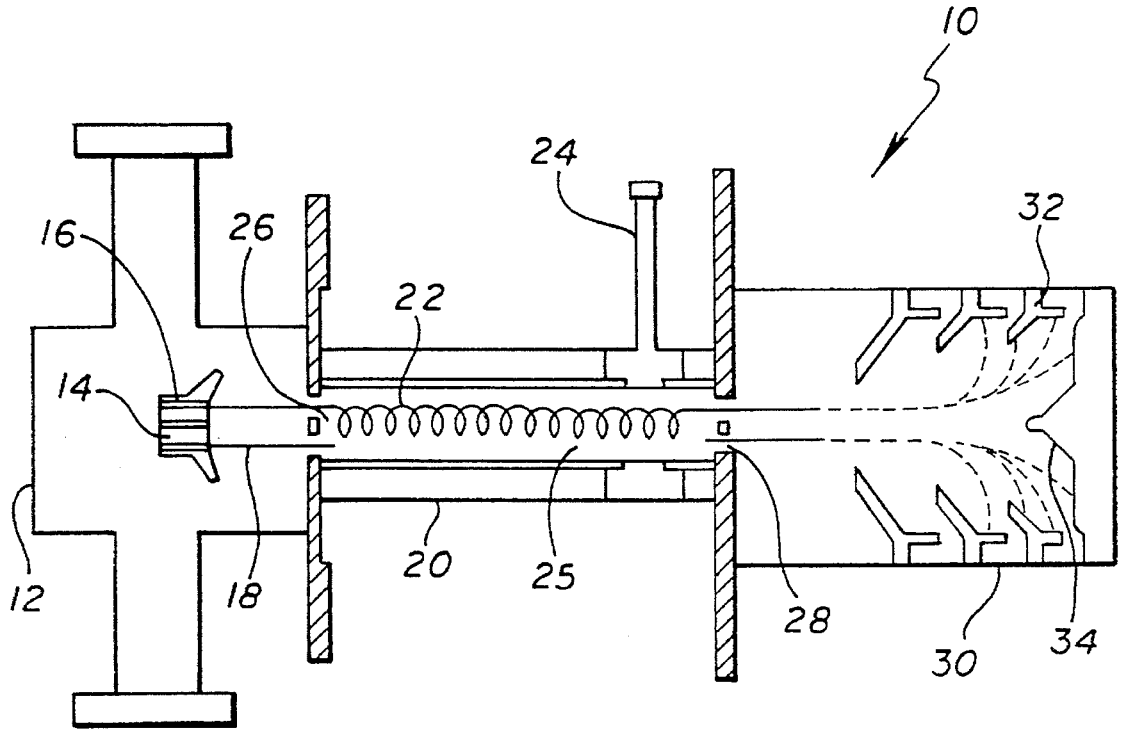
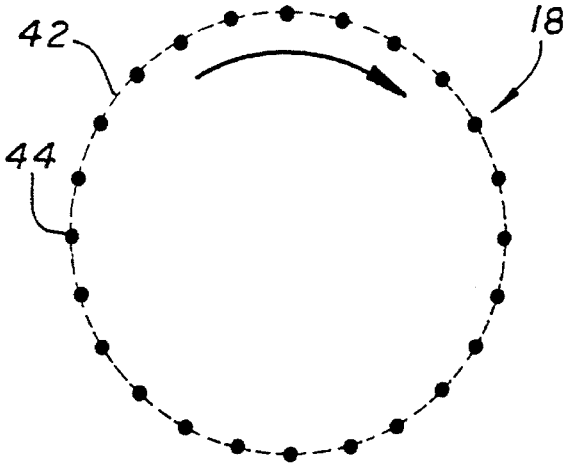
FIG. 2a
FIG. 2b
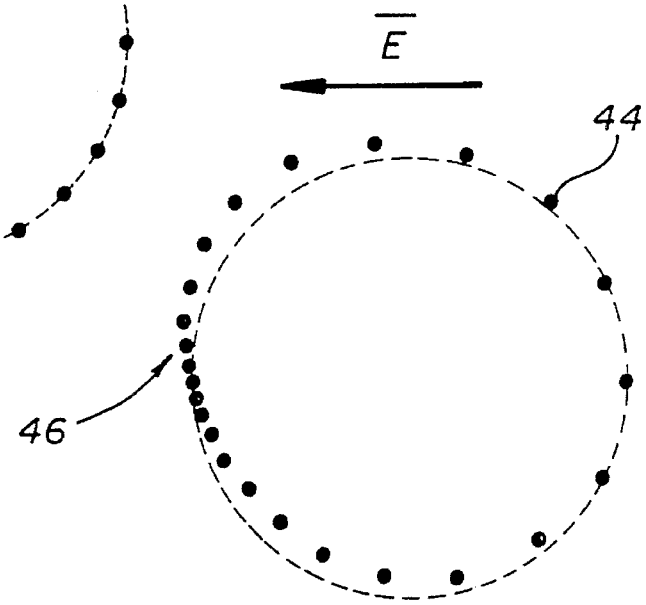

FIG. 6a (PRIOR ART)
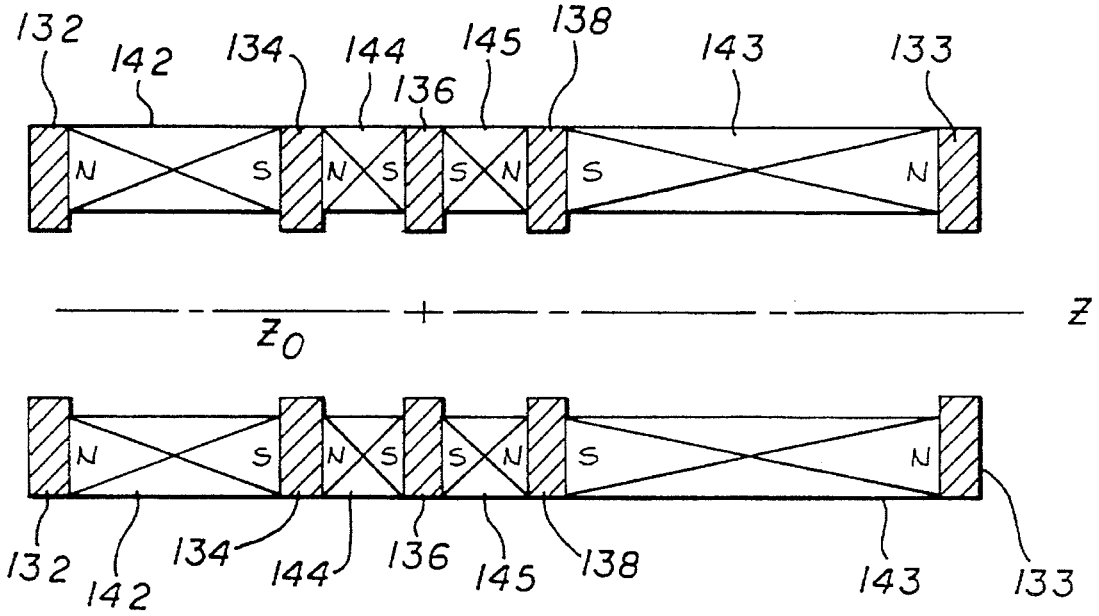
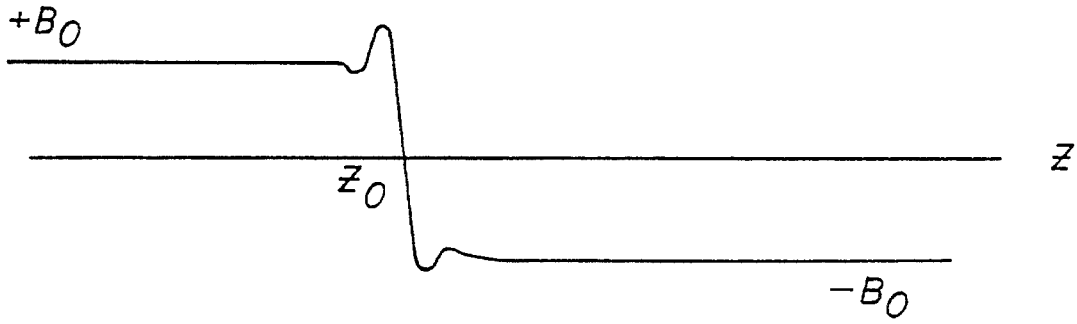
FIG. 6b (PRIOR ART)
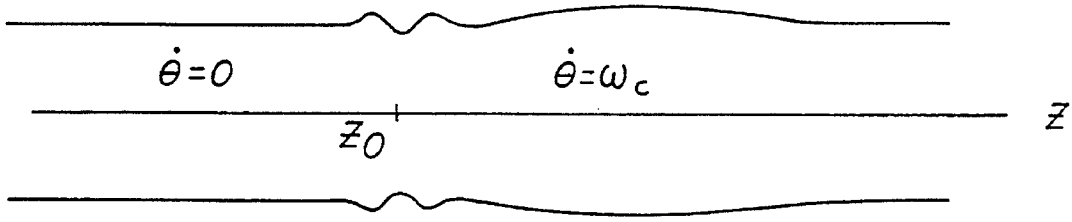
FIG. 6c (PRIOR ART)

ADVANCED CENTER POST ELECTRON GUN

This invention was made with support under contract N00014-90-C-2060 awarded by the Naval Research Laboratory. The United States Government has certain rights in this invention.

BACKGROUND OF THE INVENTION

1. Field of the Invention

The present invention relates to an improved electron gun, and more particularly, to an advanced center post (ACP) gun for producing a hollow electron beam having either a small orbit or a large orbit.

2. Description of Related Art

It is well known in the art to utilize a linear beam device within a traveling wave tube (TWT), klystron, magnetron or other microwave device. In a linear beam device, an electron beam originating from an electron gun is caused to propagate through a tunnel or a drift tube generally containing an RF interaction structure. At the end of its travel, the electron beam is deposited within a collector or beam dump which effectively captures the spent electron beam. The beam is generally focused by magnetic or electrostatic fields in the interaction structure of the device in order for it to be effectively transported from the electron gun to the collector without loss to the interaction structure. An RF wave can be made to propagate through cavities within the interaction structure and interact with the electron beam which gives up energy to the propagating wave. Thus, the microwave device may be used an amplifier for increasing the power of a microwave signal.

The electron gun which forms the electron beam typically comprises a cathode and an anode. The cathode includes an internal heater which raises the temperature of the cathode surface to a level sufficient for thermionic electron emission to occur. When the potential of the anode is positive with respect to the cathode, electrons are drawn from the cathode surface and moved towards the anode. The geometry of the cathode and anode provide an electrostatic field shape which defines the electron flow pattern. The electronic flow then passes from the electron gun structure to the interaction region of the microwave device. An electron gun of this type is known as a Pierce gun.

In one particular type of Pierce gun, a hollow electron beam is formed. By varying the axial magnetic field, the electrons in the hollow beam can be made to orbit some of the magnetic flux lines. As the magnetic field is increased, a significant fraction of the axial energy of the electron beam is converted to motion transverse to the beam axis. This gyrating beam is used in several microwave devices which convert the transverse energy of the beam into RF energy. Examples of these devices are the peniotron, gyrotron, gyroBWO, gyroTWT, etc. A prior art gyrotron is shown in FIG. 1.

The cathode of a hollow beam gun is generally annular so that it emits a circular beam of electrons 18, as shown in FIG. 2*a*. The hollow beam can be characterized as either a large orbit beam in which the electrons 44 spiral about a guiding center of the beam near the axis of the microwave device in a circular path 42, or a small orbit beam in which the electrons orbit around individual flux lines of the guiding magnetic field in the interaction region. The rotation of the electrons in a large orbit beam is induced by a magnetic field reversal at the front end of the interaction region. The large and small orbit beams are shown graphically at FIGS. 2*a* and 3, respectively.

One class of devices utilize large orbit beams for production of a microwave output through a process known as cyclotron resonance maser (CRM) interaction. Maser is an acronym for microwave amplification using stimulated emission of radiation. CRM interaction devices extract rotational energy from the beam in radial cavities disposed within the interaction region. The electrons 44 orbit about the guiding center at a rate known as the cyclotron frequency $\Omega_c$. The space charge forces within the gyrating electron beam result in azimuthal bunching 46 of the orbiting electrons, shown graphically in FIG. 2*b*. If the frequency of the propagating RF wave is slightly greater than the cyclotron frequency, the electron bunches fall back into a decelerating field and transfer their energy to that field. Interaction can also take place at harmonics of the cyclotron frequency. In this case, multiple bunches are formed equally spaced about the cyclotron orbit.

Both the efficiency and stability of CRM devices and peniotrons are strongly dependant on the ratio of transverse velocity to axial velocity of the beam, known as $\alpha$. In these devices, the $\alpha$ value is usually between 1 and 2. Increasing $\alpha$will raise the efficiency of these devices until the device becomes unstable. In order to obtain maximum efficiency of energy transfer to the RF wave, uniform transverse and axial velocity of the orbiting electrons is desired.

In practice, such velocity uniformity is difficult to achieve. A standard magnetron injection gun (MIG) has a conical cathode which produces a small orbit beam that is constrained to move axially by the applied magnetic field. In the standard MIG gun, magnetic flux threads the cathode in order to control the beam radius and improve beam stability. However, this type of MIG gun is impractical for producing a large orbit beam since the variation in flux across the cathode surface translates to variation in angular velocity after the magnetic field reversal. Other electron gun designs utilize a shielded cathode with a center post to reduce or eliminate the magnetic field at the cathode and decreases the transverse velocity spread. However, the beam radius of these guns is typically limited to the cathode radius, and can not be readily adjusted to accommodate very short wavelength RF signals, such as in the millimeter wavelength range. Thus, these shielded cathode designs have not been successfully applied in forming large orbit axis encircled beams in these applications.

SUMMARY OF THE INVENTION

Accordingly, a principal object of this invention is to provide an electron gun capable of producing a hollow electron beam which can form either a large electron orbit or a small electron orbit. An additional object of this invention is to provide an advanced center post electron gun which produces an axis encircling electron beam for CRM interaction wherein the beam has reduced axial and transverse velocity variation over that of a conventional axis encircling beam. Yet another object of this invention is to provide an electron gun which produces an axis encircling large orbit beam in which the beam radius $\alpha$ and rotational frequency can be independently varied.

In accomplishing these and other objects, there is provided an electron gun having an annular shaped cathode, a control electrode adjacent the cathode, and an annular anode disposed a fixed distance from the cathode and having an opening therethrough. A center post is disposed axially within a center region of the cathode and the control electrode along a center line of the electron gun and interaction region of a microwave device. The anode is shaped in conjunction with the center post to control position of equipotential lines of an electric field provided in an inter-electrode space between the cathode and the anode so that an electron beam emitted by the cathode converges at the opening in the anode. The control electrode provides electrostatic focusing of the beam to further control the beam convergence.

In particular, the control electrode further comprises an inner and an outer beam control electrode spaced a fixed distance from the cathode. A bias voltage is provided between the outer and inner beam control electrodes, to deflect the electron beam relative to the center line and to determine the convergence point of the beam.

In one embodiment of the invention, a magnetic field reversal is applied after the convergence point of the electron beam. A triple polepiece structure is provided to perform the magnetic field reversal. The polepieces have tapered ends which minimize the axial length in which there is an absence of magnetic field. Once it passes the field reversal point, a portion of the axial velocity of the electron beam is converted to angular velocity, resulting in a rotation of the beam at the cyclotron frequency $\omega_c$. The guiding center for this rotation is at or near the beam axis.

In an additional embodiment of the invention, the center post has a liquid cooled core. Spiralling coolant channels extend axially through the center post beneath the outer surface of the center post. A coolant exhaust channel extends through the center of the center post. A coolant fluid entering the center post flows through the radial coolant channels, and then is exhausted through the central channel. The coolant maintains the center post at a constant temperature, which prevents deformation of the center post surface.

A more complete understanding of the electron gun of the present invention will be afforded to those skilled in the art as well as a realization of additional advantages and objects thereof, by a consideration of the following detailed description of the preferred embodiment. Reference will be made to the appended sheets of drawings, which will be first described briefly.

BRIEF DESCRIPTION OF THE DRAWINGS

FIG. 1 is a diagrammatic side view of a prior art hollow beam gyrotron having a cathode assembly, an interaction area, and a collector;

FIG. 2*a* is a sectional view of a gyrating electron beam;

FIG. 2*b* is a view as in FIG. 2*a* showing azimuthal electron bunching due to a transverse electric field;

FIG. 6*a* shows a prior art triple polepiece magnetic field reversal configuration;

FIG. 6*b* is a graph showing the reversal of magnetic flux density through the triple polepiece of FIG. 6*a*;

FIG. 6*c* is a graph showing the behavior of an electron beam passing through the field reversal element of FIG. 6*a*;

DESCRIPTION OF THE PREFERRED EMBODIMENT

Figure 3:
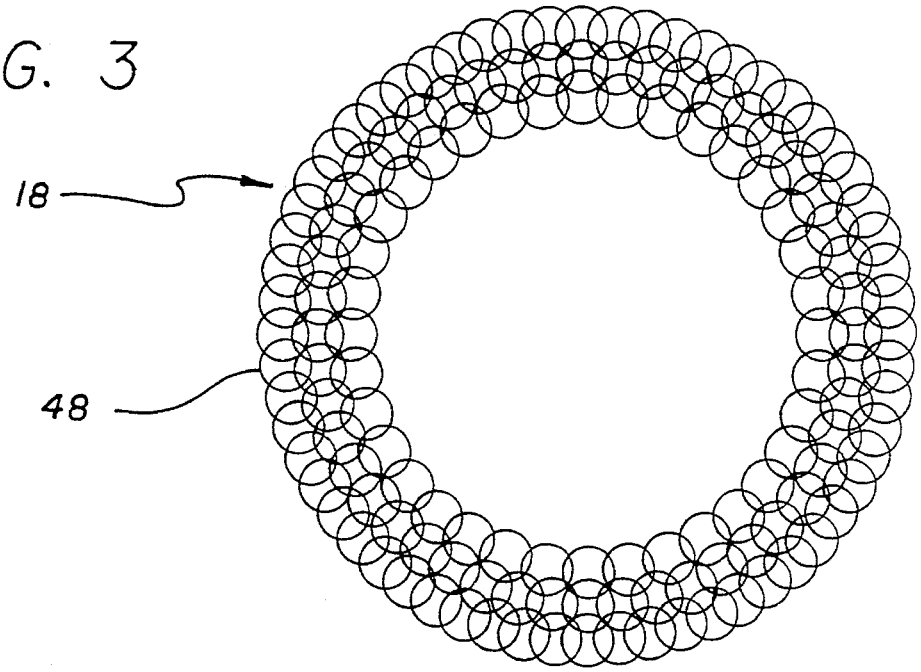
FIG. 3 shows a normal small orbit gyrotron beam.

The present invention represents a significant improvement over the prior art gyrotron electron guns, in that it permits a single gun to produce either a small orbit or a large orbit electron beam. Moreover, a large orbit beam produced with this gyrotron gun experiences dramatically reduced axial and transverse velocity spreads over the prior art devices, which significantly increases the efficiency of CRM interaction.

Referring first to FIG. 1, a diagram of a prior art gyrotron assembly 10 is shown. An electron gun assembly 12 has a thermionic emitting cathode 14 with an emitting surface 16 that emits a circular electron beam 18. The beam 18 passes from the electron gun assembly 12 into an interaction structure 20 through a centrally disposed interaction region 25 of the structure. A magnetic field reversal occurs at an initial portion 26 of the interaction structure 20, which imparts an angular velocity on the electron beam, resulting in the beam spiraling as shown at 22. An RF signal is introduced into the interaction structure 20 through one or more couplers 24. The RF signal interacts with the spiraling beam and energy from the beam transfers to the moving wave.

At the end of the interaction structure 20, the spent electron beam exits the interaction structure through the second aperture 28 and is gathered in the collector 30. Before exiting the interaction structure 20, the spiraling beam 22 passes a second magnetic field reversal, which linearizes the beam. The now linear beam enters the collector 30 and is rapidly decelerated by numerous stages of depression electrodes 32. Each of the stages of depression electrodes 32 have increasingly negative voltages applied to rapidly decelerate the electrons of the linearized beam, so that only a small portion of the electrons reach the back wall 34 of the collector 30. By dispersing the electrons in this manner, the electrons do not focus on any one individual point in the collector, which would generate excess heat that can overstress or cause damage to the collector structure.

In the absence of the first field reversal, the individual electrons of the beam 18 would produce the small orbit beam 48 shown in FIG. 3. Rather than gyrating about the centerline of the beam, the individual electrons would gyrate around the magnetic field lines within the interaction region 25. The radius of the orbit path around the magnetic field lines is known as the Larmor radius of the beam. In a small orbit beam, the Larmor radius is relatively small relative to the guiding center of the beam. However, in a large orbit beam the Larmor radius is roughly equivalent to the radius relative to the guiding center of the beam.

Figure 4:
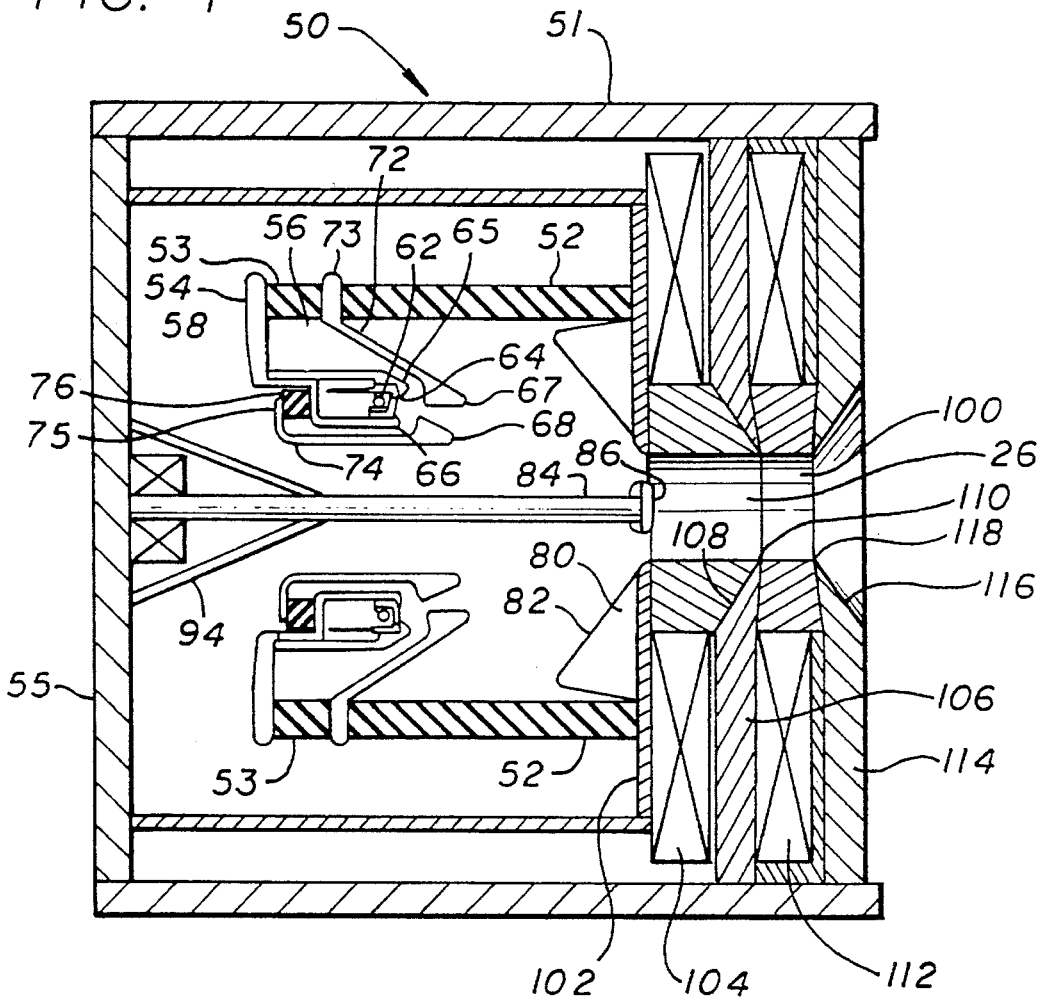
FIG. 4 is a side sectional view of a gyrotron electron gun of the present invention.
Figure 5:
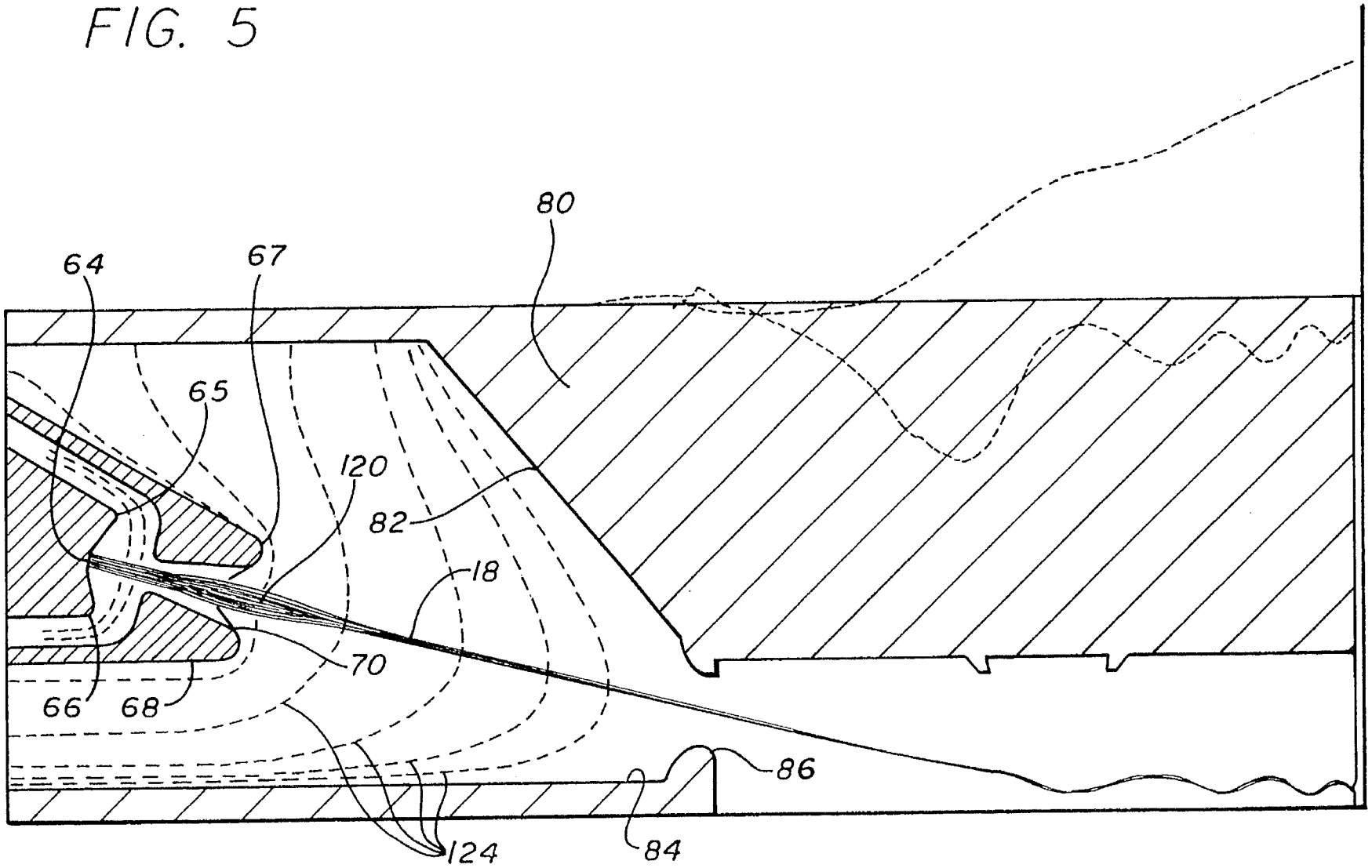
FIG. 5 is an enlarged side view of the electron gun showing the equipotential lines between the cathode and anode.

Referring now to FIGS. 4 and 5 there is shown an electron gun 50 of the present invention. The gun has an outer support structure 51 and a backwall 55. The structure 51 is generally cylindrical in shape, as are a majority of the components of the electron gun. Due to this cylindrical geometry, the side view of FIG. 4 shows the symmetry of the gun. Thus, it should be apparent that like elements from the upper and lower portions of the figure are counterparts of the same component.

An internal cylindrical structure 57 supports the gun assembly as will be described below. Insulating support cylinders 52 and 53 are disposed concentric within the outer structure 51 and inner cylinder 57. The support cylinders 52 and 53 electrically insulate the various components of the gun and provide structural support for the cathode components. A cathode support ring 54 is secured to an end of the insulating support cylinder 53. The support ring 54 and support cylinder 53 can be secured together by brazing or other known joining technique. The support ring 54 is annular in shape and extends inwardly relative to the support cylinder 53.

A cathode assembly 56 is secured to an inner diameter portion of the cathode support ring 54. The cathode assembly 56 has an inner core 58 with a heater filament 62 disposed below an external emitting surface 64. The emitting surface 64 has a generally concave annular shape. A highly negative voltage of approximately −5 kilovolts is applied to the cathode emitting surface 64. The internal heater filament 62 increases the temperature of the surface to produce thermionic emission of electrons from the surface.

At an outside diameter and inside diameter of the emitting surface 64, outer and inner focus electrodes 65 and 66 are disposed, respectively. The focus electrodes 65 and 66 are electrically connected to the emitting surface 64, and contribute to shaping the electric field as will be further described below. In the preferred embodiment, the focus electrodes 65 and 66 form a 62.5° angle with the emitting surface 64. The focus electrodes 65 and 66 ensure that the electron beam remains uniform as it exits the cathode.

Adjacent to the cathode emitting surface 64, outer and inner beam control electrodes 67 and 68 are provided. The inner beam control electrode 68 extends from a support cylinder 74 having a lower flange which mounts to an insulator ring 76 secured to a rear portion of the cathode assembly 56. The outer beam control electrode 67 extends from a support cone 72 which attaches to the insulating support cylinders 52 and 53. The support cone 72 has an annular ring portion 73 which is sandwiched between the support cylinders 52 and 53. The ring portion 73 secures to the support cylinders 52 and 53 by known joining technique, such as by brazing. A bias voltage of approximately 100 volts may be applied between the inner and outer beam control electrodes 67 and 68, as will be further described below.

An anode 80 is disposed a fixed distance from the cathode and the beam control electrodes 67 and 68. The anode 80 has an external surface 82 having a generally angled portion which contributes to shaping the electric field. The angle formed between the anode surface 82 and the cathode emitting surface 64 is roughly equal to the angle formed between the emitting surface and the center post 84. The anode 80 is maintained at ground potential, and thus is highly positive with respect to the cathode. Typically, the anode 80 is made of copper material.

The center post 84 is disposed along a centerline of the electron gun 50, and is concentric with the cathode assembly 56. The center post 84 has a rounded cap 86 which extends into the first aperture 26 leading to the interaction region 100. The center post 84 is rigidly secured to the back wall 55 of the electron gun by a support cone 94. It is critical that the center post 84 be as stiff as possible, since any deformation of the center post would alter the electric and magnetic fields and consequently the electron beam.

With the negative voltage applied to the cathode, an electric field is formed between the cathode surface 64, the anode 80, and the center post 84. Since the cathode surface 64 is highly negative with respect to the anode 80 and center post 84, a beam of electrons 18 are drawn from the emitting surface 64. The electron beam 18 and the equipotential lines 124 of the electric field are shown graphically in FIG. 5. The equipotential lines 124 fall along the outer surface of the center post 84. Since the center post 84 carries the magnetic flux enclosed by the beam, no magnetic field variation occurs across the cathode surface. The cathode 56 and control electrodes 67 and 68 are enclosed within the iron cylinder 57 and backwall 55 such that the cathode region is magnetic field free. All the magnetic flux that would normally be present within the cathode diameter is carried by the center post 84. The electron beam 18 follows a path which is generally perpendicular to the equipotential lines. Thus, it should be apparent that the direction of the beam can be controlled by selecting the angle of the anode surface 82 relative to the position of the center post 84 to control the shape of the equipotential lines.

A beam control voltage is provided between the cathode surface 64 and the beam control electrodes 67 and 68. This beam control voltage is up to 4,000 volts, and provides electrostatic focusing of the beam 18. The shape of the beam control electrodes 67 and 68 produces a compound electrostatic lens which causes beam divergence 120 at the entrance of the lens and beam convergence at the exit 70. This has the effect of increasing the annular width of the beam and extends the "throw" of the beam. The throw of the beam is the distance from the cathode emitting surface 64 to the plane where the annular width of the beam is at its minimum value. This minimum annular width plane is positioned at the center of the magnetic field reversal described below, in order to achieve minimum velocity spread in the beam. The electrostatic lens effect is shown graphically in FIG. 5.

Between the inner and outer beam control electrodes 67 and 68, a small bias voltage is applied to deflect the beam trajectories slightly in order to optimize the entrance angle into the magnetic field reversal. This voltage is nominally less than one percent of the cathode to anode voltage. Thus, varying the shape, control voltage and bias voltage of the beam control electrodes 67 and 68 each contributes to altering the orbit radius of the beam, and its velocity and guiding center spread.

Once the circular beam reaches the interaction region 100, it remains focused at the minimum orbit radius by the magnetic field disposed within the interaction region. The individual electrons of the beam would tend to gyrate around the magnetic field lines, producing a small orbit beam. However, if it is desired to produce a large orbit beam, a larger portion of the electron's axial velocity must be converted to a transverse or angular velocity. To accomplish this, a magnetic field reversal is provided.

As known in the art, a magnetic field reversal would impart an azimuthal force on the moving electrons. The field reversal can be accomplished by simply reversing the polarity of the magnetic field $B_o$ within the interaction region forming a boundary in which the field changes from $+B_o$ to $-B_o$. However, it has been found that an abrupt change in field causes ripples or scalloping of the beam downstream from the field reversal point. The scalloping causes inefficient CRM interaction and should be avoided. To minimize this scalloping, a triple polepiece magnetic field reversal element is applied.

An example of a triple polepiece element is shown in FIG. 6*a*. The element comprises outer polepieces 132 and 133, a first inner polepiece 134, a second inner polepiece 136, and a third inner polepiece 138. Outer magnets 142 and 143 are provided between the outer polepiece 132 and first inner polepiece 134, and the outer polepiece 133 and third polepiece 138, respectively. Inner magnets 144 and 145 are disposed between the first and second inner polepieces 134 and 136 and the second and third inner polepieces 136 and 138, respectively. As shown in FIG. 6*a*, the polarity of the outer magnet 142 and inner magnet 144, are equivalent, as are the outer magnet 143 and inner magnet 145. These magnets can be either permanent magnets or solenoid coils.

The arrangement results in the change in magnetic flux density Z shown in FIG. 6*b*. There is an abrupt change in the magnetic field, from $+B_o$ to $-B_o$, during which there is a point of zero magnetic flux $Z_o$. FIG. 6*c* shows the behavior of the electron beam 18 passing through the reversal point at $Z_o$. At the first portion of the beam, the beam rotation $\Theta$ is equal to zero. After the field reversal, the rotation of the beam $\Theta$ is equal to the cyclotron frequency $\omega_c$.

The triple polepiece magnetic field reversal is applied in the present invention to initiate gyration of the hollow electron beam 18. To further minimize the scalloping of the beam, and to produce a more uniform axial and transverse velocity, the polepieces are tapered to minimize the axial length of the zero magnetic field region. Referring to FIG. 4, a first polepiece 102 is disposed at the beginning of the interaction region 100 and has the anode 80 secured thereto. A first magnet 104 is disposed adjacent the first polepiece 102 and adjoins a second polepiece 106. Similarly, a second magnet 112 is disposed alongside the second polepiece 106 and a third polepiece 114. Both the second and third polepieces 106 and 114 have tapered surfaces 108 and 116, respectively. The tapered surfaces 108 and 116 are generally convergent, and result in end points 110 and 118, respectively. It has been found that these tapered polepieces effectively reduce the axial length of the zero magnetic field region, and further minimize deformation of the gyrating beam 18 after the field reversal point.

The preferred embodiment of an advanced center post gun 150 of the present invention which takes advantage of the inventive concepts discussed above, is shown in FIGS. 7 and 8. The gun has an outer support structure 151 and a back wall 155. An insulating support cylinder 152 is disposed concentric within the outer structure 151 and provides structural support to the cathode assembly 156. The cathode assembly 156 has a heater filament 162 disposed below the emitting surface 164. The emitting surface 164 has a generally annular conic shape. Outer and inner focus electrodes 165 and 166, respectively, are disposed adjacent the emitting surface 164.

Outer and inner beam control electrodes 167 and 168 are provided adjacent the cathode emitting surface 164. The outer and inner beam control electrodes 167 and 168 are physically supported by the insulating support cylinder 152.

Figure 7:
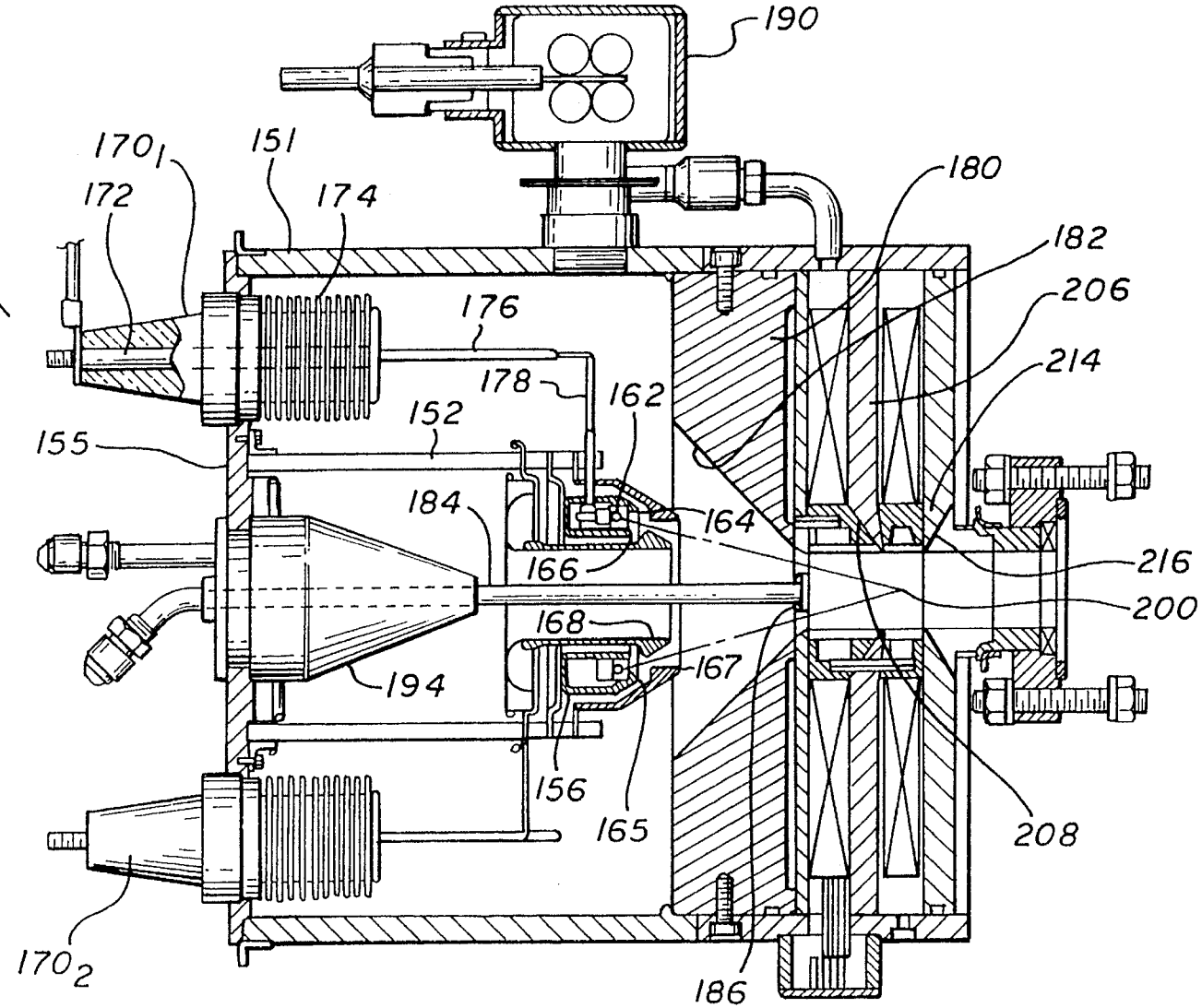
FIG. 7 is a detailed side view of a preferred embodiment of the gyrotron electron gun of the present invention.

To provide electrical connection to the cathode emitting surface 164, the heater filament 162, and the inner and outer control electrodes 167 and 168, a plurality of electrical feedthroughs $\mathbf{170}_1$ and $\mathbf{170}_2$ are provided. Each feedthrough is formed of an electrically insulative and thermally conductive material, such as ceramic. The feedthroughs 170 have a central conductive core 172 which provides electrical conduction from outside the gun 150 to within the gun. The internal portion of the feedthrough has a plurality of thermally radiating fins 174. An extension rod 176 carrying a wire 178 extends from the core 172 to a depth equivalent with the component to which the electrical connection is desired. In FIG. 7, a first feedthrough $\mathbf{170}_1$ is shown providing an electrical connection to the cathode heater 162, and a second feedthrough $\mathbf{170}_2$ is shown providing a connection to the inner control electrode 167. Although not shown in the figure, it should be understood that a third feedthrough provides an electrical connection to the cathode emitting surface 164, and a fourth feedthrough provides an electrical connection to the outer control electrode 168.

An anode 180 is shown disposed adjacent to the cathode assembly 156 and control electrodes 167 and 168. As described above, an angle formed by the anode surface 182 is selected so that the electron beam roughly bisects the angle between the anode surface 182 and the center post 184. FIG. 7 shows an estimated convergence point within the interaction region 200 of the gyrotron.

The triple polepiece field reversal element is also shown, with a center polepiece 206 having a tapered end 208, and an outer polepiece 214 with a tapered end 216. The tapered ends 208 and 216 converge towards each other. In the preferred embodiment, the field reversal point approximately coincides with that of the beam convergence point.

Also included in FIG. 7 is an ion pump 190. As known in the art, the generation of an electron beam often results in the development of undesired ions within the gun structure 151. The ion buildup can be detrimental to the operation of the gun. Accordingly, the pump 190 removes ions from within the gun structure 151 and maintains a near vacuum environment.

Figure 8:
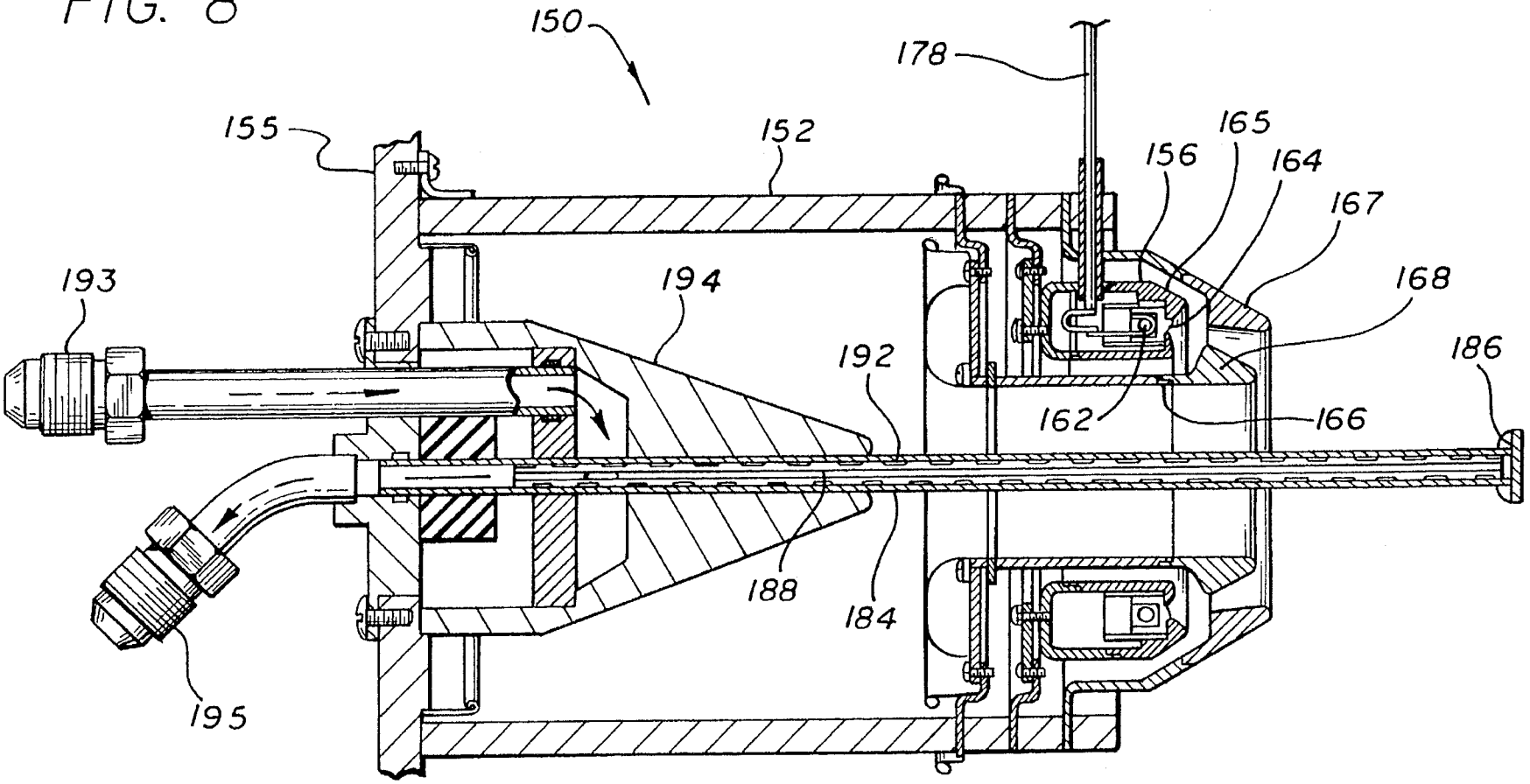
FIG. 8 is an enlarged side view as in FIG. 7.

As described above, it is necessary to maintain the center post 184 at a near uniform temperature so as to avoid deformation of the center post surface. To accomplish this, a coolant fluid radiates from intake 193 into the center post 184 and through spiral channels 192 disposed below the surface of the center post as shown in FIG. 8. The coolant fluid then exhausts through center drain 188 to exhaust line 195. The center post 184 is rigidly secured to the back wall 155 by the use of a support cone 194.

Having thus described a preferred embodiment of an advanced center post gun, it should now be apparent to those skilled in the art that the aforestated objects and advantages for the within system have been achieved. Although the present invention has been described in connection with the preferred embodiment, it is evident that numerous alternatives, modifications, variations, and uses will be apparent to those skilled in the art in light of the foregoing description. For example, alternative materials, joining techniques, voltages, and spacing can be selected to vary the operating characteristics of an electron gun as contemplated by the invention.

The present invention is further defined by the following claims:

1. An electron gun for producing a hollow electron beam for use in a microwave device having a voltage source and an interaction region in which said beam interacts with a propagating RF signal applied thereto, the gun comprising:

an annular cathode;

an anode spaced a fixed distance from said cathode, said anode having an aperture for passage of said beam therethrough, said cathode being negatively charged by the voltage source applied thereto with respect to said anode;

a center post disposed within a center region of said cathode along an axis of said gun and said interaction region, said center post terminating at said aperture of said anode, wherein an angle which is defined between said cathode and said anode is equivalent to an angle which is defined between said cathode and said center post;

control means spaced between said anode and said cathode for electrostatically focusing said beam to control a convergence point of said beam;

means for providing a magnetic field in a region of said beam convergence point, and means for reversing direction of said magnetic field, wherein a magnetic field reversal region occurs along the axis of the electron gun and the microwave device downstream of said beam convergence point, away from said cathode, said beam being a large orbit beam in which the electrons spiral about the axis of the electron gun after passing said magnetic field reversal region, wherein said magnetic field reversing means comprises a plurality of polepieces secured between said anode and said interaction region including a central polepiece and an outer polepiece.

2. The electron gun of claim 1, wherein said control means further comprises:

an inner and an outer control electrode respectively disposed relative to said cathode such that said beam passes between said inner and outer control electrodes, and means for providing each of said inner and outer control electrodes with a respective positive voltage relative to said cathode to provide said electrostatic focusing.

3. The electron gun of claim 2, wherein said inner and outer control electrodes have a bias voltage defined as a difference between said positive voltage provided to said inner control electrodes and said positive voltage provided to said outer control electrode to deflect a trajectory of said beam.

4. The electron gun of claim 1, wherein said microwave device is a peniotron.

5. The electron gun of claim 1, wherein each said polepiece has respective generally tapered surfaces, said surfaces minimizing axial extent of said field reversal region.

6. The electron gun of claim 5, wherein said tapered surfaces converge toward each other.

7. The electron gun of claim 1, wherein said cathode has a generally conic shape.

8. The electron gun of claim 1, wherein said center post has a liquid cooled core.

9. An electron gun for producing a hollow electron beam for use in an interaction region of a microwave device, the gun having a voltage source electrically connected thereto and comprising:

an annular cathode;

an anode spaced a fixed distance from said cathode, said anode having an aperture for passage of said beam therethrough, said cathode being negatively charged by the voltage source with respect to said anode;

a center post located within a center region of said cathode positioned axially along an axis of said gun and said interaction region extending through said cathode, said center post terminating at said aperture of said anode, wherein an angle which is defined between said cathode and said anode is equivalent to an angle which is defined between said cathode and said center post;

control means spaced between said anode and said cathode for electrostatically focusing said beam to control a convergence point of said beam;

means for providing a magnetic field in a region of said beam convergence point; and more than one polepiece secured between said anode and said interaction region for creating a magnetic field reversal region, said polepieces including a central polepiece and an outer polepiece, wherein said magnetic field reversal region occurs along the axis of the electron gun and the microwave device downstream of said beam convergence point, away from said cathode, said beam being a large orbit beam in which the electrons spiral about the axis of the electron gun after passing said magnetic field reversal region.

10. The electron gun of claim 9, wherein each said polepiece has respective generally tapered surfaces, said surfaces converging toward each other and minimizing axial extent of said field reversal region.

11. The electron gun of claim 9, wherein said control means further comprises:

an inner and an outer control electrode respectively disposed relative to said cathode such that said beam passes between said inner and outer control electrodes, and means for providing at least one of said inner and outer control electrodes with a positive voltage with respect to said cathode to provide said electrostatic focusing.

12. The electron gun of claim 11, wherein said inner and outer control electrodes have a bias voltage defined as a difference between said positive voltage provided to said inner control electrodes and said positive voltage provided to said outer control electrode to deflect a trajectory of said beam.

13. An electron gun for producing a hollow electron beam for use in a microwave device having a voltage source electrically connected thereto and a region in which said beam interacts with a propagating RF signal, the gun comprising:

an annular cathode having a conic surface;

an anode spaced a fixed distance from said cathode, said anode having an aperture for passage of said beam therethrough, said cathode being negatively charged by the voltage source with respect to said anode;

a center post located within a center region of said cathode along an axis of said gun and said interaction region, said center post terminating at said aperture of said anode, wherein an angle which is defined between said cathode and said anode is equivalent to an angle which is defined between said cathode and said center post;

control means located between said anode and said cathode for electrostatically focusing said beam to control a convergence point of said beam; and means for providing a magnetic field in a region of said beam convergence point, and means for reversing direction of said magnetic field, wherein a magnetic field reversal region occurs along the axis of the electron gun and the microwave device downstream of said beam convergence point, away from said cathode, said beam being a large orbit beam in which the electrons spiral about the axis of the electron gun after passing said magnetic field reversal region, wherein said magnetic field reversing means is secured between said anode and said interaction region and comprises a plurality of polepieces.

14. The electron gun of claim 13, wherein said center post has a liquid cooled core.

15. The electron gun of claim 14, wherein said center post has spiral coolant channels.

16. The electron gun of claim 13, wherein each said polepiece has respective tapered surfaces, said surfaces converging toward each other and minimizing axial extent of said field reversal region.

17. The electron gun of claim 13, wherein said control means further comprises:

an inner and an outer control electrode respectively disposed relative to said cathode such that said beam passes between said inner and outer control electrodes, and means for providing each of said inner and outer control electrodes with a respective positive voltage relative to said cathode to provide said electrostatic focusing.

18. The electron gun of claim 17, wherein said inner and outer control electrodes have bias voltage defined as a difference between said positive voltage provided to said inner control electrodes and said positive voltage provided to said outer control electrode to deflect a trajectory of said beam.

19. An electron gun for producing a hollow electron beam for use in a microwave device having an RF interaction region, the electron gun having an annular cathode and an anode with an inter-electrode region defined therebetween, said anode having an aperture for passage of said beam therethrough, the gun comprising:

a ferromagnetic cylinder enclosing said inter-electrode region electrically connected to said anode;

means for producing a magnetic field coupled to said ferromagnetic cylinder between said anode and the interaction region;

a center post electrically connected to said ferromagnetic cylinder, said center post terminating at said aperture of said anode and located along an axis of the inter-electrode region, wherein magnetic flux of said magnetic field is conducted through said center post and said ferromagnetic cylinder providing a magnetic field free region within the inter-electrode region; and wherein said magnetic field producing means further comprises more than one polepiece secured between said anode and said interaction region for creating a magnetic field reversal region, said polepieces including a central polepiece and an outer polepiece for reversing the direction of the magnetic field in a region of said beam convergence point, wherein a magnetic field reversal region occurs along the axis of the electron gun and the microwave device proximate the beam convergence point, said beam being a large orbit beam in which the electrons spiral about the axis of the gun after traversing said magnetic field reversal region.

20. The electron gun of claim 19, further comprising means for electrostatically focusing said beam located between said anode and said cathode.

21. The electron gun of claim 20, wherein said electrostatically focusing means further comprises:

an inner and an outer control electrode respectively disposed relative to said cathode such that said beam passes between said inner and outer control electrodes, and means for providing each of said inner and outer control electrodes with a respective positive voltage relative to said cathode to provide said electrostatic focusing.

22. The electron gun of claim 21, wherein said inner and outer control electrodes have a bias voltage therebetween to deflect a trajectory of said beam.

23. The electron gun of claim 19, wherein each said polepiece has respective generally tapered surfaces, said surfaces minimizing axial extent of said field reversal region.

24. The electron gun of claim 19, wherein a first angle is defined as an angle between said cathode and said anode and is equivalent to a second angle which is defined as an angle between said cathode and said center post.

25. The electron gun of claim 24 further comprising a voltage source electrically connected to said cathode for providing said cathode with a highly negative voltage with respect to said ferromagnetic cylinder, said anode and said center post, whereby said first angle and said second angle define equipotential lines of an electric field which direct said beam into a convergence point in the interaction region.

* * * * *